US009656792B2

(12) United States Patent
Awalt

(10) Patent No.: US 9,656,792 B2
(45) Date of Patent: May 23, 2017

(54) PRODUCE DISPLAY PAD

(71) Applicant: Terry Awalt, Brownville, ME (US)

(72) Inventor: Terry Awalt, Brownville, ME (US)

( * ) Notice: Subject to any disclaimer, the term of this patent is extended or adjusted under 35 U.S.C. 154(b) by 0 days.

(21) Appl. No.: 15/288,953

(22) Filed: Oct. 7, 2016

(65) Prior Publication Data

US 2017/0021988 A1 Jan. 26, 2017

Related U.S. Application Data

(63) Continuation-in-part of application No. 14/717,709, filed on May 20, 2015, now abandoned.

(51) Int. Cl.

| | |
|---|---|
| ***B65D 81/02*** | (2006.01) |
| ***B65D 25/04*** | (2006.01) |
| ***B65D 81/24*** | (2006.01) |
| ***B65D 85/34*** | (2006.01) |
| ***A47F 7/00*** | (2006.01) |
| ***A47F 5/10*** | (2006.01) |
| ***B65D 81/26*** | (2006.01) |
| ***B65D 85/30*** | (2006.01) |

(52) U.S. Cl.

CPC ..... *B65D 81/022* (2013.01); *A47F 5/108* (2013.01); *A47F 7/0007* (2013.01); *B65D 25/04* (2013.01); *B65D 81/24* (2013.01); *B65D 81/262* (2013.01); *B65D 85/30* (2013.01); *B65D 85/34* (2013.01)

(58) Field of Classification Search

CPC .... B65D 85/34; B65D 81/113; B65D 81/022; B65D 25/04; A47F 8/0071; A47F 5/16; A47F 3/14; A47F 7/0071; A47F 7/0007

USPC ..... 206/589, 564, 521.1, 521.3, 521.8, 588, 206/523, 587; 220/507, 516, 508

See application file for complete search history.

(56) References Cited

U.S. PATENT DOCUMENTS

| | | | | |
|---|---|---|---|---|
| 1,917,735 A | | 7/1933 | Roberts | |
| 2,722,719 A | | 11/1955 | Altstadter | |
| 2,951,624 A | * | 9/1960 | Schwebs | B65D 5/48024 206/521.6 |
| 3,282,458 A | * | 11/1966 | Rudd | B65D 85/322 206/503 |
| 3,695,479 A | * | 10/1972 | Crabtree | B65D 85/34 206/521.1 |
| 4,872,723 A | * | 10/1989 | Kopf | B60R 21/00 108/44 |
| 5,022,183 A | * | 6/1991 | Bohlmann | A01G 9/088 206/423 |

(Continued)

*Primary Examiner* — Steven A. Reynolds
(74) *Attorney, Agent, or Firm* — Anthony D. Pellegrini

(57) ABSTRACT

A monolithic display device for the point-of-sale display of produce manufactured out of a closed cell foam material and of solid construction, with a plurality of pockets formed into the top surface of the device and arranged in horizontal rows separated by upwardly extending horizontal dividing members, with upwardly extending intermediate dividing members separating adjacent pockets within each row. The display device is used in a retail setting by first being placed onto a table or other means of support, and then having produce placed onto the top surface within the pockets. The horizontal dividing members and the intermediate dividing members hold the produce in place on the device, while the foam construction of the device protects the produce from damage. In some embodiments different sized pockets are formed into the lower surface of the device so that the device can be used with different sized produce.

31 Claims, 8 Drawing Sheets

(56) References Cited

U.S. PATENT DOCUMENTS

| | | | | |
|---|---|---|---|---|
| 5,680,929 | A | 10/1997 | Von Seidel | |
| 6,010,007 | A * | 1/2000 | Moren | B65D 25/107 206/454 |
| 6,648,154 | B2 | 11/2003 | Awalt | |
| 6,872,338 | B2 | 3/2005 | Awalt | |
| 8,556,078 | B1 * | 10/2013 | Farco | A61J 1/03 206/528 |
| D695,047 | S | 12/2013 | Awalt | |
| 8,887,931 | B2 | 11/2014 | Awalt | |
| 2003/0141218 | A1 * | 7/2003 | Stephens | B65D 1/30 206/484 |
| 2004/0055910 | A1 * | 3/2004 | Boorman | G11B 33/0422 206/308.1 |
| 2010/0219093 | A1 * | 9/2010 | Motadel | B01L 3/54 206/443 |
| 2012/0228187 | A1 * | 9/2012 | Pharr | A47G 23/06 206/557 |

* cited by examiner

PRODUCE DISPLAY PAD

CROSS REFERENCE TO RELATED APPLICATION

This application is a continuation-in-part of U.S. Ser. No. 14/717,709, filed May 20, 2015 and currently pending, entitled PRODUCE DISPLAY PAD, by Terry Awalt, which is hereby incorporated by reference.

BACKGROUND OF THE INVENTION

1. Technical Field

The present invention relates generally to retail display devices for the point-of-sale display of produce and, more particularly, to a produce display pad constructed out of closed cell foam to support and protect produce while creating an aesthetically pleasing display.

2. Description of Prior Art

Produce display pads are well known in the industry. Conventional display pads are constructed of cardboard or other paper-based materials. They typically are used initially as shipping material between layers of produce packed in boxes. The produce is lifted out of the boxes on the display pads, and the display pads are placed onto display stands or in refrigerated display cases. However, because of their disposable nature, typical display pads are fragile and decompose quickly, especially in display cases where the produce is regularly misted. They also are aesthetically unappealing and provide minimal protection for the produce placed thereon. The device claimed herein seeks to reduce these deficiencies.

It is therefore an objective of the present invention to provide a produce display pad that is monolithic in construction.

It is a further objective of the present invention to provide a produce display pad that does not contain seams, joints, or gaps.

It is yet a further objective of the present invention to provide a produce display pad that is durable.

It is yet a further objective of the present invention to provide a produce display pad that is impervious to water, mold, and bacteria.

It is yet a further objective of the present invention to provide a produce display pad that protects the produce placed thereon from bruising.

It is yet a further objective of the present invention to provide a produce display pad that displays the produce placed thereon in an aesthetically pleasing manner.

It is yet a further objective of the present invention to provide a produce display pad that is reversible, allowing for the display of one size of produce on one side and a different size of produce on the other side.

It is yet a further objective of the present invention to provide a produce display pad that is simple to manufacture.

It is yet a further objective of the present invention to provide a produce display pad that is light weight and easy to ship.

Other objectives of the present invention will be readily apparent from the description that follows.

SUMMARY OF THE INVENTION

In one aspect, the invention is directed to a device for displaying produce, comprising a monolithic display member constructed of a closed cell foam material, such as closed cell pvc foam. The display member is substantially planar, with a top surface and a lower surface. The lower surface is substantially flat, allowing for the display member to be placed on a surface such as a display stand or the rack of a refrigerated display case. The top surface of the display member has formed into it a series of regular sized, relatively shallow pockets, said pockets arranged in a grid pattern. The pockets are oriented side to side in rows, with rows of pockets extending front to back. Horizontal dividing members separate horizontal rows of pockets and intermediate dividing members separate individual pockets within each row. Each pocket is substantially rectangular and has a lowest point, with the lowest point located substantially in the center of the pocket. The dimensions and depth of each pocket are substantially the same as the dimensions and depth of each other pocket.

The horizontal dividing members separating each row of pockets extend upward from the top surface of the display member, and are wider closer to the top surface of the display member and taper significantly as they extend upward away from the top surface of the display member, culminating in a relatively sharp top edge. Each horizontal dividing member has a height measured from the top edge of the horizontal dividing member to the lowest point of a pocket. The height of each of the horizontal dividing members is substantially the same as the height of each other horizontal dividing member.

The intermediate dividing members extend upward away from the top surface of the display member, and are wider closer to the top surface of the display member and become somewhat narrower as they extend upward from the top surface of the display member, culminating in a rounded top edge. Each intermediate dividing member has a height measured from the top edge of the intermediate dividing member to the lowest point of a pocket. The height of each of the intermediate dividing members is substantially the same as the height of each other intermediate dividing member. The heights of the horizontal dividing members are greater than the heights of the intermediate dividing members.

The horizontal and intermediate dividing members serve to retain produce placed onto the top surface of the display member within each pocket. The heights of the horizontal and intermediate dividing members are designed to provide optimum visibility to produce placed on the display member while helping to keep it from rolling side to side and forward. The pockets allow the merchandiser to merchandise produce easier because each unit fits in a specific spot on the display member and will not move while placing the rest of the product. This allows even inexperienced merchandisers to build aesthetically pleasing displays. The horizontal and intermediate dividing members also provide retention means for keeping produce from shifting when the display member is tilted at an angle or when additional produce is placed on top of the first layer of produce. For improved display of produce, display devices are often inclined such that the front portion is oriented lower than the rear portion, while the device is maintained substantially level from left to right. Forward tilting is desirable for a fuller looking display. The horizontal dividing members therefore are used to arrest forward movement of produce when the display member is tilted, and thus have to be of at least a minimum height. This also makes it easier to rotate product when merchandising because product stays in place when set in the device and does not roll forward. Product will stay fresher longer because it is not moving and bumping against other produce, minimizing bruising and increasing the time of salability. When refilling the display it allows produce to be rotated easier because the horizontal and intermediate dividing members allow the merchandiser to keep the produce in place near the top of the display while filling the lower portion of the display and then waterfalling the existing produce on top of the newly merchandised product. Because there is little to no lateral tilting, on the other hand, the intermediate dividing members need not be as tall as the horizontal dividing members, as there is little lateral movement of the produce. However, when produce is stacked, it is typically stacked by placing a piece of produce onto pieces of produce already placed on the display member over the interstitial space between the pieces of said produce, forming a pyramidal structure. The newly added unit of produce exerts lateral forces on the underlying produce, thus requiring there to be at least some height to the intermediate dividing members in addition to the height of the horizontal dividing members. Even when the device is oriented substantially flat and contains only a single layer of produce, the horizontal dividing members and the intermediate dividing members serve to minimize lateral movement of the produce as it is selected by customers, helping to protect the produce from bruising that could otherwise occur from rolling and bumping.

This aspect of the invention may include one or more of the following features: the display member has two or more horizontal rows of pockets; each horizontal row of pockets has two or more pockets therein; each horizontal row of pockets has the same number of pockets as each other horizontal row of pockets; the horizontal dividing members are oriented substantially parallel to each other; the intermediate dividing members are oriented substantially parallel to each other; each horizontal dividing member extends from the left side of the display member to the right side of the display member; each intermediate dividing member extends between an adjacent pair of horizontal dividing members; one horizontal dividing member is located substantially along the front side of the display member; one horizontal dividing member is located substantially along the rear side of the display member; the left and right sides of the display member are substantially parallel; the front and rear sides of the display member are substantially parallel; each lateral side of the display member is substantially perpendicular to each other lateral side to which it is adjacent and substantially perpendicular to the bottom of the display member; the display member may be configured with small, medium, or large pockets, to accommodate different types of produce; and the display member may be configured with different dimensions in order to fit onto differently sized display stands or display cases.

In another aspect of the invention the lower surface of the device is configured in the same manner as the top surface, as described above. In this aspect the dimensions of the pockets formed into the lower surface are different from the dimensions of the pockets formed into the top surface. This allows the same device to be used for two different kinds of produce (for example, stone fruit on one side and non-stone fruit on the other side), or for a single type of produce with a range of sizes (for example, regular oranges and jumbo oranges), merely by flipping the device over.

Other features and advantages of the invention are described below.

DETAILED DESCRIPTION OF INVENTION

Figure 4:
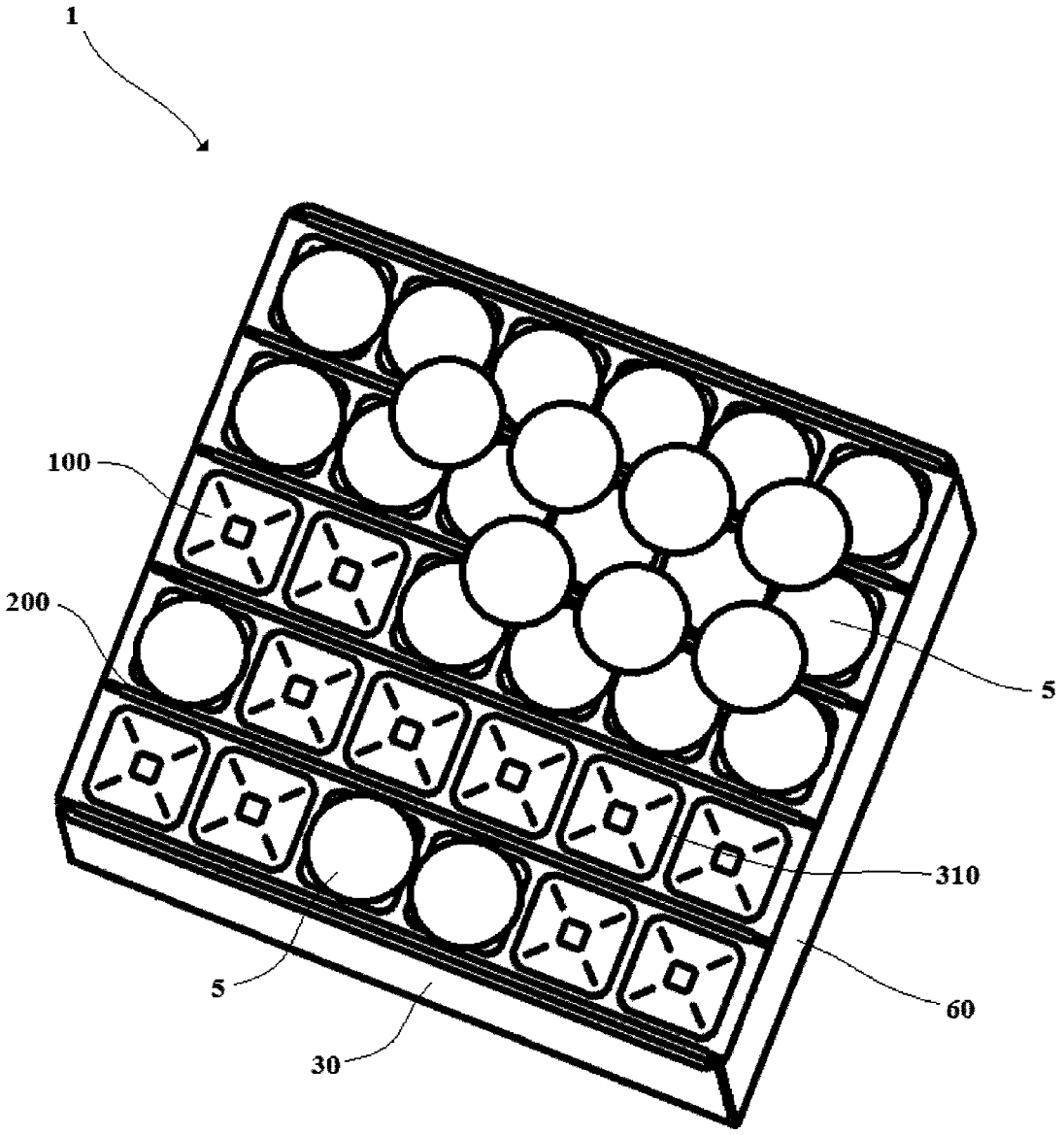
FIG. 4 is a perspective top view of the display member depicted in FIG. 1, showing the display member in use with produce partially stacked thereon.

FIG. 4 shows a perspective view of one embodiment of a produce display device 1. In this embodiment, the produce display device 1 is a monolithic, flexible display member constructed entirely of a foam material, and having a top surface 10, a lower surface 20, a front side 30, a rear side 40, a left side 50, and a right side 60. Formed into the top surface 10 of the display member 1 is a plurality of pockets 100. Produce 5 is placed onto the top surface 10 into the pockets 100. The pockets 100 hold the produce 5 in place, thereby reducing the possibility that the produce 5 will roll or slide off the produce display device 1, while still allowing the produce 5 to be visible and easily accessible.

The produce display device 1 is manufactured using a foam material. The foam may be open celled or closed celled. In the preferred embodiment the foam is closed cell, such as closed cell pvc foam. The foam construction cushions the produce 5 and reduces bruising or other damage. Due to its foam construction, the produce display device 1 is light weight, flexible, and fully immersible in water for easy cleaning and storage. It also is capable of being rolled up and unrolled. This feature allows for easier shipping of the device 1, for example, by rolling it up and placing it into a shipping tube, which is far less costly than shipping the device 1 in a flat shipping container. In preferred embodiments, the foam material is impregnated with an antimicrobial agent.

Figure 1:
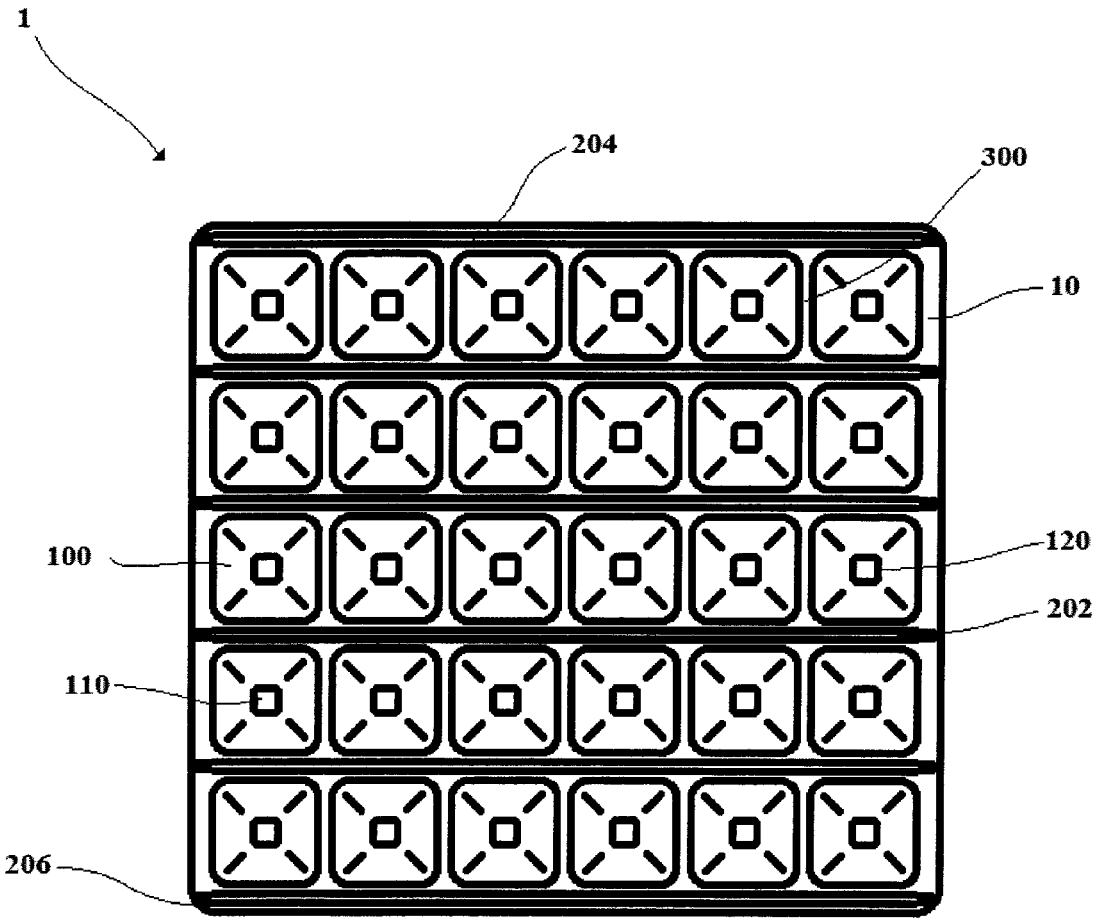
FIG. 1 is a perspective top view of the display member.

Each pocket 100 of the display member 1 is substantially rectangular and has a lowest point 110 located at a central portion 120 of the pocket 100. Other pocket 100 shapes are also contemplated, such as squares, hexagons, octagons, and circles. The dimensions and depth of each pocket 100 are substantially the same as the dimensions and depth of each other pocket 100. The pockets 100 are arranged in two or more horizontal rows wherein each row contains two or more pockets 100. Each row has the same number of pockets 100 as each other row, and each individual pocket 100 is vertically aligned with a pocket 100 in an adjacent horizontal row of pockets 100. See FIG. 1. Other configurations of the pockets 100 is also contemplated, for example where a different number of pockets 100 may be found in each horizontal row, or some pockets 100 may have different dimensions and/or shapes than other pockets 100.

Figure 2A:
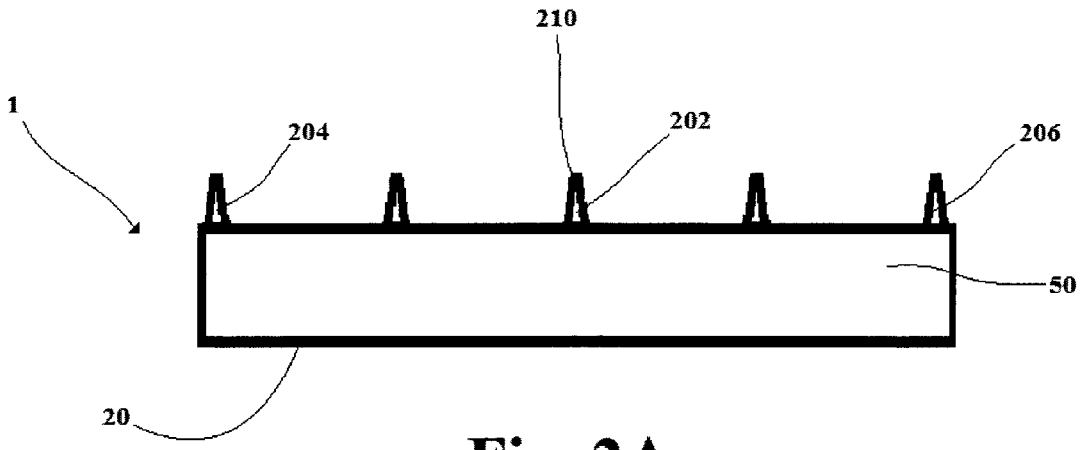
FIG. 2A is a plan side view of the display member depicted in FIG. 1. The opposite plan side view of the display member is substantially identical to FIG. 2A.
Figure 3A:
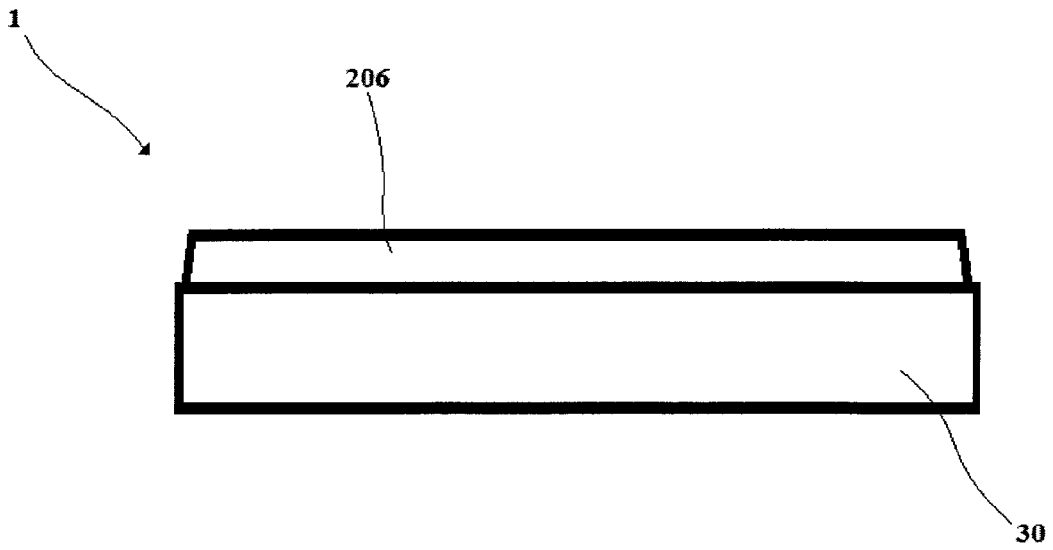
FIG. 3A is a plan front view of the display member depicted in FIG. 1. The plan rear view of the display member is substantially identical to FIG. 3A.
Figure 6A:
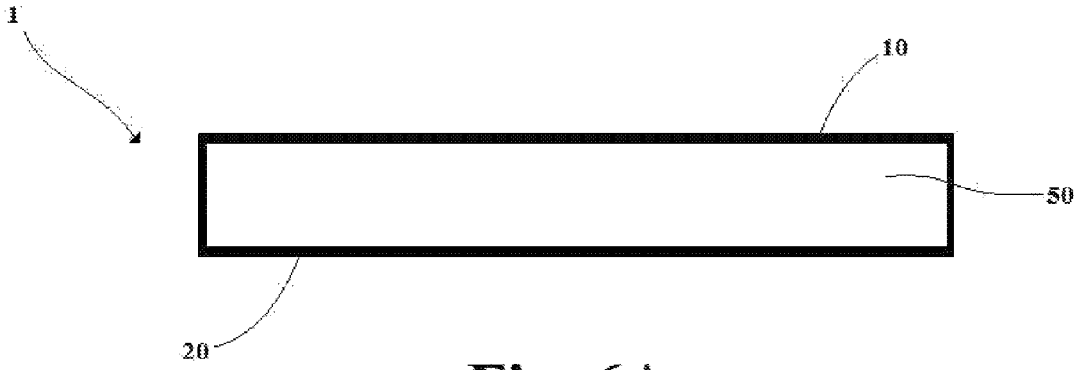
FIG. 6A is a plan side view of the embodiment of the display member having pockets formed into both the top surface and the lower surface, but without horizontal dividing members extending beyond the respective top or lower surfaces. The opposite plan side view of the display member is substantially identical to FIG. 6A.
Figure 6B:
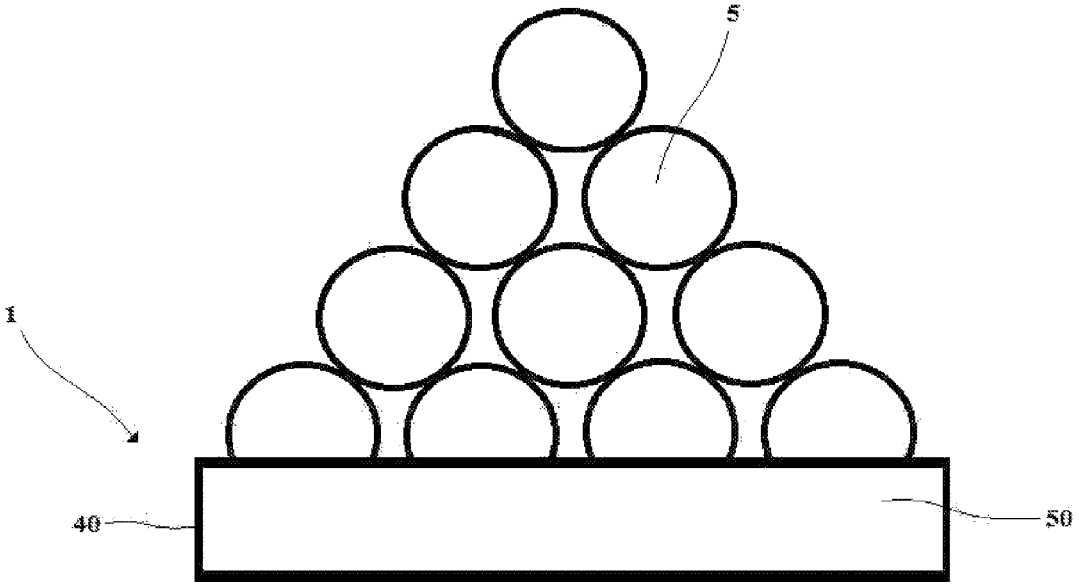
FIG. 6B is a plan side view of the display member depicted in FIG. 6A, showing the display member in use with produce stacked thereon.

Separating the horizontal rows of pockets 100 are one or more interior horizontal dividing members 202. Each interior horizontal dividing member 202 separates a pair of adjacent horizontal rows of pockets 100. See FIG. 1. There may also be a rear horizontal dividing member 204 located along the rear side 40 of the display member 1, and a front horizontal dividing member 206 located along the front side 30 of the display member 1. Each of the horizontal dividing members 200 is elongate and extends laterally from the left side 50 of the display member 1 to the right side 60 of the display member 1. See FIG. 3A. This lateral extension of the horizontal dividing members 200 may reach the outer perimeter of the display member 1, or there may be a narrow lip along the top surface 10 adjacent to the left side 50 and right side 60 of the display member 1 creating a small separation of the horizontal dividing members 200 from the perimeter of the display member 1. In preferred embodiments, each of the horizontal dividing members 200 is oriented substantially parallel to each other of the horizontal dividing members 200. In some embodiments, each horizontal dividing member 200 extends upward from the top surface 10 of the display member 1 in a substantially vertical orientation. In preferred embodiments, each horizontal dividing member 200 is wider closer to the top surface 10 of the display member 1 and tapers significantly as it extends upward away from the top surface 10 of the display member 1, culminating in a relatively sharp top edge 210. See FIG. 2A. This may be seen as each horizontal dividing member 200 having a substantially triangular cross section, or a substantially trapezoidal cross section, or a cross section substantially triangular with a rounded apex. Each horizontal dividing member 200 has a height measured from its top edge 210 to the lowest point 110 of a pocket 100 adjacent to it. In preferred embodiments, the height of each of the horizontal dividing members 200 is substantially the same as the height of each other horizontal dividing member 200. In the most preferred embodiments the horizontal dividing members 200 exhibit all of the foregoing properties. In the preferred embodiments, the horizontal dividing members 200 are formed from and integrated with the top surface 10 of the display member 1. In other embodiments the horizontal dividing members 200 are separately formed and then attached to the top surface 10 of the display member 1. In yet other embodiments the top edges 210 of the horizontal dividing members 200 do not extend above the top surface 10 of the device. See FIGS. 6A and 6B.

Within each horizontal row of pockets 100, a plurality of intermediate dividing members 300 separates a pair of adjacent pockets 100 within a row. See FIG. 1. Each of the intermediate dividing members 300 is oriented substantially parallel to each other of the intermediate dividing members 300 located within the same horizontal row. Each of the intermediate dividing members 300 extends between a pair of horizontal dividing members 200, and is oriented substantially perpendicular to said pair of horizontal dividing members 200. This extension of the intermediate dividing members 300 may reach the adjacent horizontal dividing members 200 or there may be a narrow gap along the bases of the horizontal dividing members 200 creating a small separation of the intermediate dividing members 300 from the adjacent horizontal dividing members 200. In some embodiments, each intermediate dividing member 300 extends upward from the top surface 10 of the display member 1. Each intermediate dividing member 300 is wider closer to the top surface 10 of the display member 1 and tapers slightly as it extends upward away from the top surface 10 of the display member 1, culminating in a rounded top edge 310. This may be seen as each intermediate dividing member 300 having a cross section substantially triangular with a rounded apex. Each intermediate dividing member 300 has a height measured from its top edge 310 to the lowest point 110 of a pocket 100 adjacent to it. The height of each of the intermediate dividing members 300 is substantially the same as the height of each other intermediate dividing member 300 and the height of each horizontal dividing member 200 is greater than the height of each intermediate dividing member 300. In the preferred embodiment, the intermediate dividing members 300 are formed from and integrated with the top surface 10 of the display member 1. In other embodiments the intermediate dividing members 300 are separately formed and then attached to the top surface 10 of the display member 1. In yet other embodiments the top edges 310 of the intermediate dividing members 300 do not extend above the top surface 10 of the device.

Figure 2B:
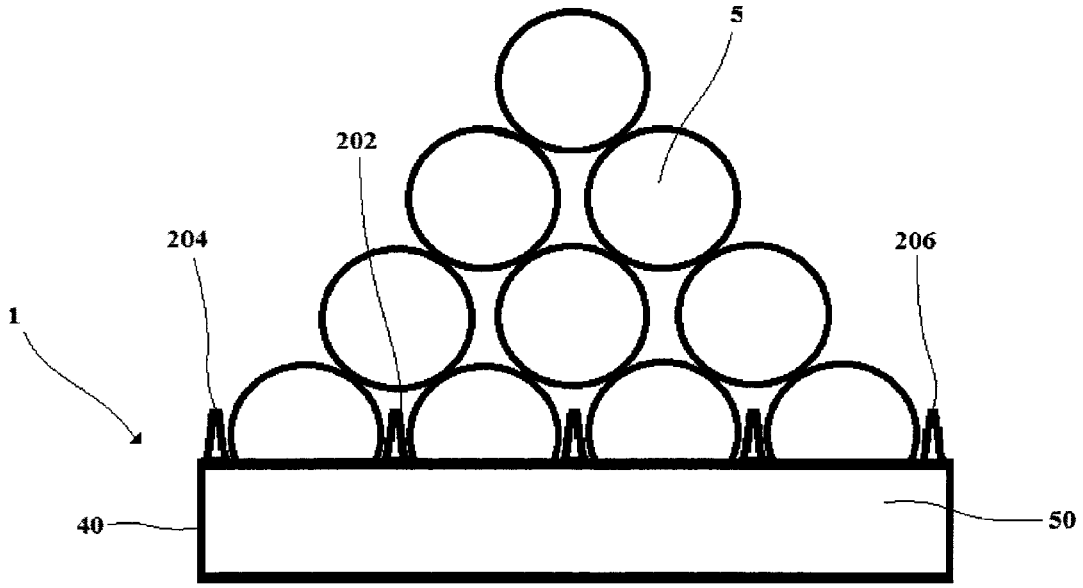
FIG. 2B is a plan side view of the display member depicted in FIG. 2A, showing the display member in use with produce stacked thereon.
Figure 2C:
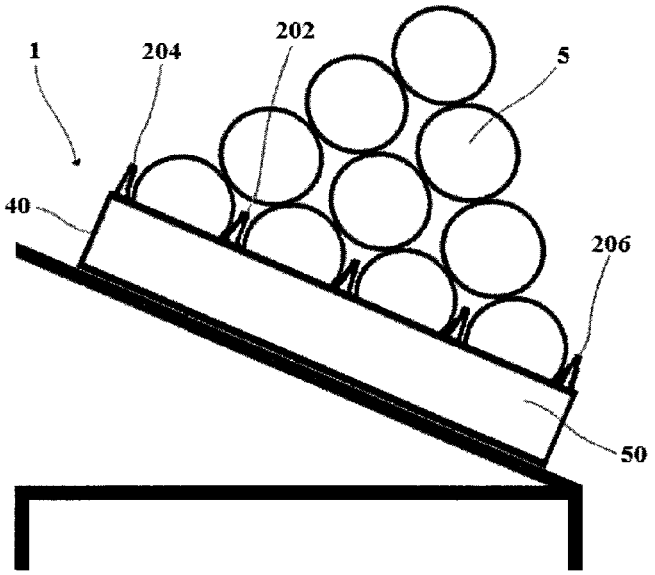
FIG. 2C is a plan side view of the display member depicted in FIG. 2A, showing the display member resting on a tilted display stand, in use with produce stacked thereon.
Figure 2D:
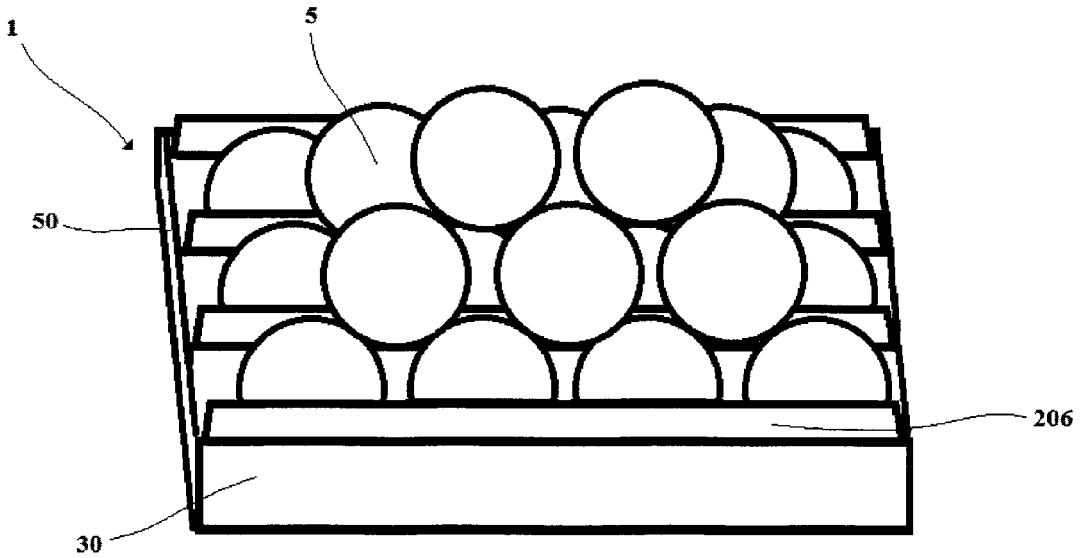
FIG. 2D is a perspective front view of the display member depicted in FIG. 2A, showing the display member in use with produce stacked thereon.

The display member 1 may have any suitable configuration. In the preferred embodiment, the lower surface 20 of the display member 1 is substantially planar and is adjacent to the front 30, rear 40, left 50, and right sides 60 of the display member. The front side 30 of the display member 1 is substantially planar and is adjacent to the left 50 and right sides 60 of the display member 1. The rear side 50 of the display member 1 is substantially planar and is adjacent to the left 50 and right sides 60 of the display member 1. The left side 50 of the display member 1 is substantially planar and the right side 60 of the display member 1 is substantially planar. The front side 30 of the display member 1 is substantially parallel to the rear side 40 of the display member 1, the left side 50 of the display member 1 is substantially parallel to the right side 60 of the display member 1, the front side 30 of the display member 1 is substantially perpendicular to the left side 50 of the display member 1, the front side 30 of the display member 1 is substantially perpendicular to the right side 60 of the display member 1, the rear side 50 of the display member 1 is substantially perpendicular to the left side 40 of the display member 1, and the rear side 40 of the display member 1 is substantially perpendicular to the right side 60 of the display member 1. See FIGS. 1, 2D, and 4. Other configurations are also contemplated, for example, where the lower surface 20 is slightly concave, or the front 30 and rear sides 40 flare outward from the top surface 10. In other embodiments the front side 30, rear side 40, left side 50, and right side 60 may be oriented with respect to each other at angles other than right angles, thereby forming a produce display device 1 having a non-rectangular base shape. This allows for the produce display device 1 to have a trapezoidal, rhomboidal, or irregular polygonal shape. In yet other embodiments, the produce display device 1 may have one or more cavities formed into its lower surface 20. The cavities can be of any shape and size, and where multiple cavities are used each may have a shape and size different from other cavities. The cavities serve to lighted the overall weight of the produce display device 1, make it easier to be flexed and even be rolled up, and save on manufacturing materials costs. Where the produce display device 1 is placed onto an inclined table or counter top, the cavities may be placed over pegs or other appendages extending upwardly from the inclined surface, thereby preventing the produce display device 1 from sliding off the inclined surface. In some embodiments, an aperture passes through the top surface and into a cavity, thereby providing drainage means. This configuration is useful for devices 1 placed in refrigerated display cases where misting occurs; the drainage apertures allow water to drain out of the device 1, thereby saving the produce from sitting in puddles of water. In other embodiments, the cavity does not penetrate completely through the produce display device 1, thereby preserving the integrity of the top surface 10.

Figure 5A:
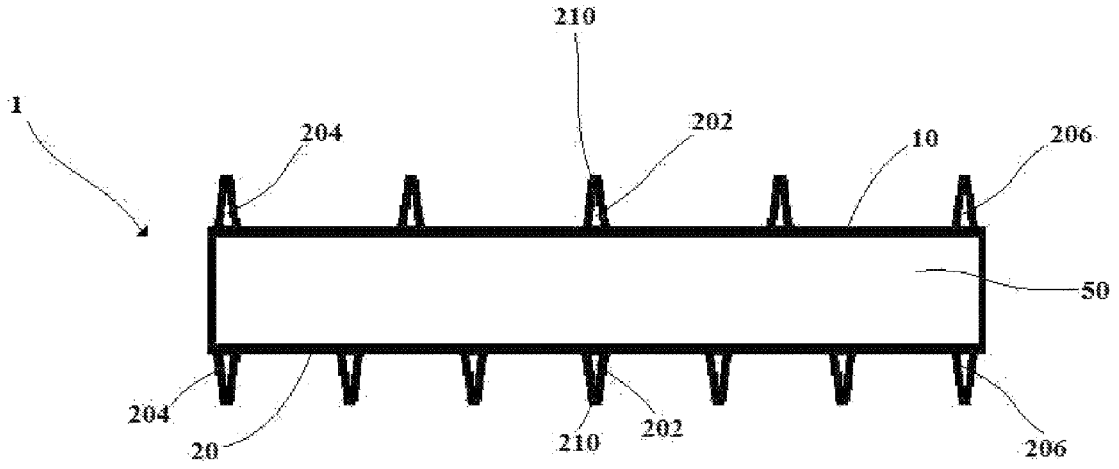
FIG. 5A is a plan side view of the embodiment of the display member having pockets formed into both the top surface and the lower surface. The opposite plan side view of the display member is substantially identical to FIG. 5A.
Figure 5B:
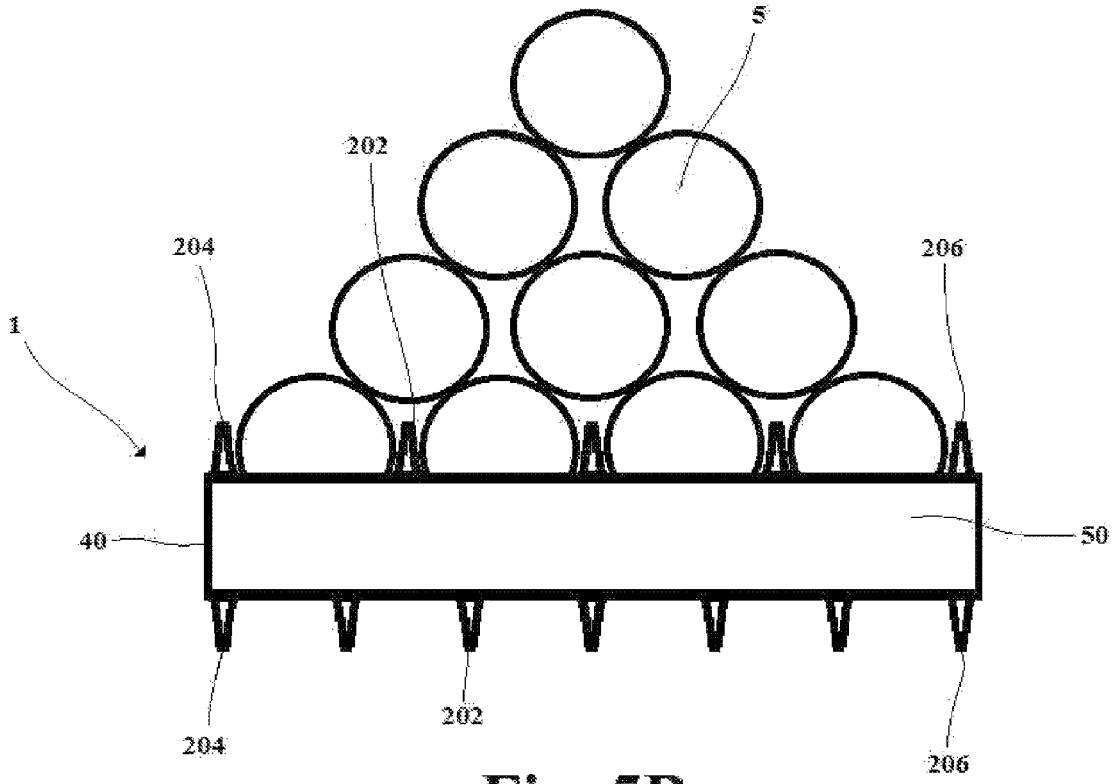
FIG. 5B is a plan side view of the display member depicted in FIG. 5A, showing the display member in use with produce stacked thereon.
Figure 5C:
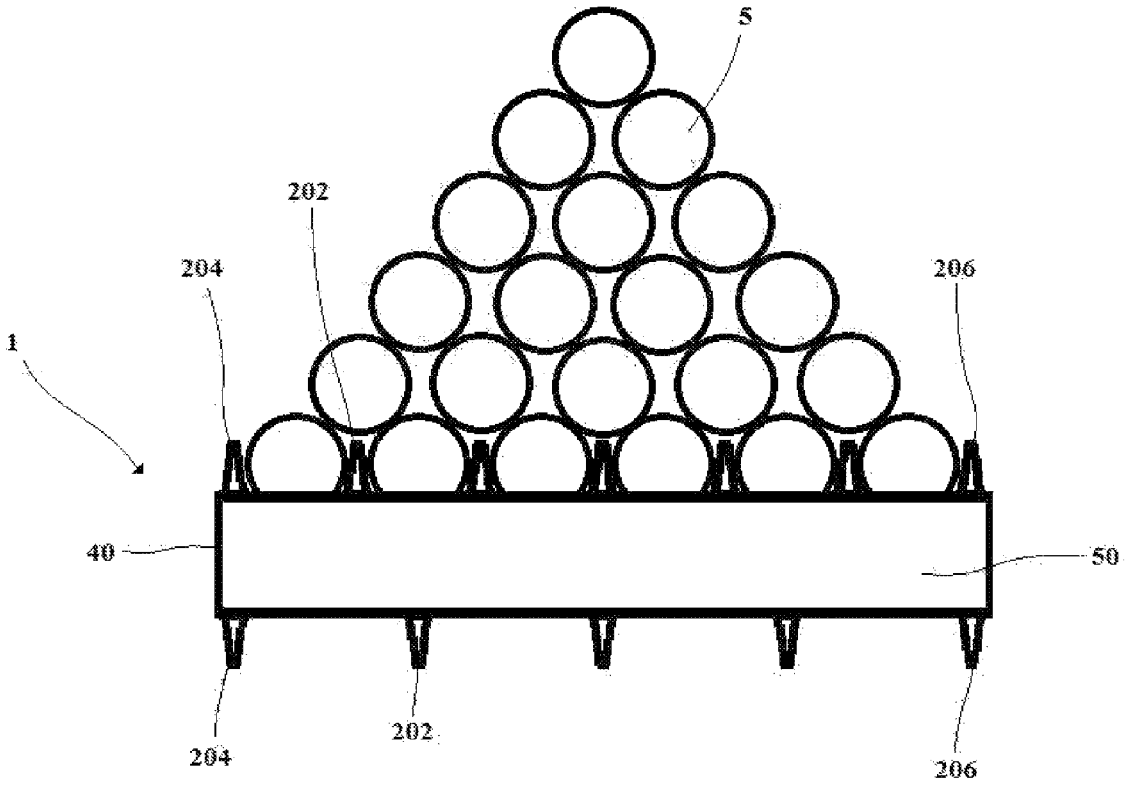
FIG. 5C is a plan side view of the display member depicted in FIG. 5B, flipped over to show the display member in use with smaller sized produce stacked thereon.

In one embodiment, the lower surface 20 of the device 1 is configured in the same manner as the top surface 1 of the device, having rows of pockets 100, interior horizontal dividing members 202, intermediate dividing members 300, an optional rear horizontal dividing member 204, and an optional front horizontal dividing member 206, all as described above. However, the pockets 100 formed into the lower surface 20 are dimensioned differently than the pockets 100 formed into the top surface 10. This allows the device 1 to accommodate different sizes of produce 5 simply by flipping the device 1 so that the surface with the appropriately dimensioned pockets 100 faces upward. See FIGS. 5A, 5B, and 5C. For example, one side would contain pockets 100 sized to accommodate apples, oranges, and other larger fruit (known as "non-stone fruit"), while the other side would contain pockets 100 sized to accommodate kiwi fruit, plums, nectarines, peaches, etc. ("stone-fruit", generally smaller than non-stone fruit).

The produce display device 1 may be of varied size. In one embodiment, its dimensions are between forty inches (101.6 cm) and sixty inches (152.4 cm) wide, as measured from left side 50 to the right side 60, between thirty inches (76.2 cm) and forty-five inches (114.3 cm) deep, as measured from front side 30 to the rear side 40, and between two inches (20.1 cm) and six inches (15.2 cm) high, as measured from bottom surface 20 to the highest point of the top surface 10. In another embodiment, its dimensions are between thirty inches (76.2 cm) and forty inches (101.6 cm) wide, as measured from left side 50 to the right side 60, between fifteen inches (38.1 cm) and thirty inches (76.2 cm) deep, as measured from front side 30 to the rear side 40, and between two inches (20.1 cm) and six inches (15.2 cm) high, as measured from bottom surface 20 to the highest point of the top surface 10. Other dimensions are also contemplated. Multiple display members 1 may be placed next to each other atop a display stand. The size of the pockets 100 of the display member 1 can be varied to accommodate large sized produce 5, such as melons or grapefruit, medium sized produce 5, such as apples or oranges, and small sized produce 5, such as peaches or nectarines.

The produce display device 1 may be manufactured using compression molding technology. It is created out of a foam material, such as closed cell pvc foam. A liquid mixture of closed cell foam material is first created. Then the liquid mixture is placed into a mold through an aperture in the mold. The liquid mixture within the mold is heated under pressure until the liquid mixture expands and completely fills the mold and solidifies. The resulting solid material is removed from the mold and placed in an oven where it expands and normalizes, and then is cooled. Trimming of the foam may be required to achieve a finished product.

Figure 3B:
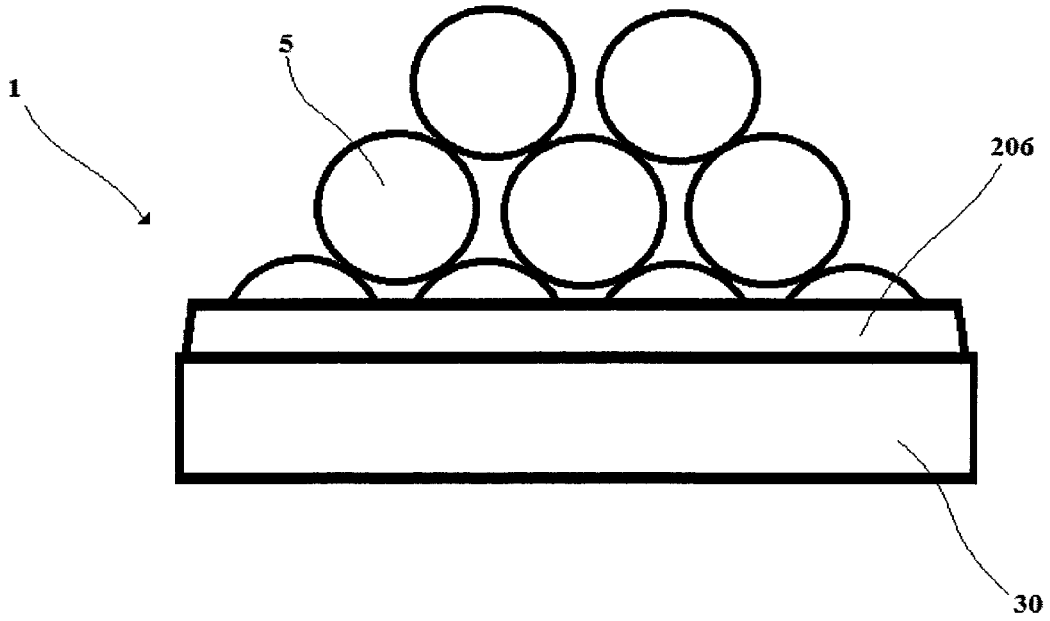
FIG. 3B is a plan front view of the display member depicted in FIG. 3A, showing the display member in use with produce stacked thereon.

Among the advantages of the produce display device 1 are the following: The produce display device 1 holds produce securely and safely while also providing a visually appealing display. The produce display device's 1 monolithic design simplifies the manufacturing process and increases manufacturing efficiency. The monolithic design, coupled with its foam material construction, eliminates the need for multiple parts and provides a surface substantially impervious to water, mold, bacteria, or other organic compounds. When closed cell foam is used, its properties also provide the benefit that, should a surface of the produce display device 1 sustain a cut or have a portion broken off, the inner surface of the cut or break will retain the same properties as the unbroken surface. In addition, because the invention is made of a foam material, it provides greater protection against bruising or damage. That is, if a surface of the produce display device 1 is damaged, the underlying material has the same cushioning properties as the surface. Thus, the produce is protected even if the produce display device 1 is damaged. Because the horizontal dividing members 200 extend upward from the top surface 10 of the display member 1, the display member 1 may be tilted back to front, and the produce 5 set thereon is held in place by the horizontal dividing members 200. See FIG. 2C. Produce 5 set onto the display member 1 is held in place by the pockets 100, so that additional produce 5 may be stacked thereon, in a pyramidal configuration, without unwanted shifting of the underlying produce 5. See FIGS. 2B and 3B. Moreover, the proper placement of the produce 5 to achieve pyramidal stacking is accurately defined by the pockets 100, eliminating the need for trial and error placement, or careful selection of produce 5 by size. Where the double-sided embodiment is used, the device 1 is more economical than comparable one-sided devices, in that it can be used for different sized produce 5. Thus, a single device 1 can be purchased instead of two. It also eliminates storage issues, in that, instead of having to remove and store units that are designed for just one size of produce 5 when the seasonal availability changes, the double-sided embodiment of the device 1 is simply flipped over to accommodate the new sized produce 5. Where large numbers of these units are being used, the elimination of having to purchase and store differently sized units results in substantial savings.

The invention is not limited to what is described in the foregoing embodiments. For example, although a produce display device 1 is described in detail, the principles described herein may be used in the construction and manufacture of any type of device for displaying other types of perishable and/or damageable goods.

Other embodiments not specifically set forth herein are also within the scope of the following claims, whereby modifications and variations can be made to the disclosed embodiments of the present invention without departing from the subject or spirit of the invention as defined in the following claims.

What is claimed:

1. A device for displaying produce, comprising:

a monolithic, flexible display member capable of being rolled up and unrolled, constructed entirely of a foam material, and having a top surface, a lower surface, a front side, a rear side, a left side, and a right side, with the top surface having formed into it a plurality of top surface pockets, said top surface pockets arranged in two or more horizontal rows wherein each row contains two or more top surface pockets with each row having the same number of top surface pockets as each other row, with the top surface having one or more horizontal dividing members, with each horizontal dividing member separating a pair of adjacent horizontal rows of top surface pockets, and with the top surface having a plurality of intermediate dividing members, with each intermediate dividing member separating a pair of adjacent top surface pockets within a row;

with the lower surface having formed into it a plurality of lower surface pockets, said lower surface pockets arranged in two or more horizontal rows wherein each row contains two or more lower surface pockets with each row having the same number of lower surface pockets as each other row, with the lower surface having one or more horizontal dividing members, with each horizontal dividing member separating a pair of adjacent horizontal rows of lower surface pockets, and with the lower surface having a plurality of intermediate dividing members, with each intermediate dividing member separating a pair of adjacent lower surface pockets within a row;

wherein the dimensions and depth of each top surface pocket are substantially the same as the dimensions and depth of each other top surface pocket, and the dimensions and depth of each lower surface pocket are substantially the same as the dimensions and depth of each other lower surface pocket.

2. The device of claim 1 wherein the display member is constructed entirely of a closed cell foam material.

3. The device of claim 2 wherein the closed cell foam material is pvc foam.

4. The device of claim 2 wherein the closed cell foam material is impregnated with an antimicrobial substance.

5. The device of claim 1 wherein the display member is constructed entirely of an open cell foam material.

6. The device of claim 1 wherein each top surface pocket is substantially rectangular.

7. The device of claim 1 wherein each individual top surface pocket is vertically aligned with a top surface pocket in an adjacent horizontal row of top surface pockets.

8. The device of claim 1 wherein each top surface pocket has a lowest point located substantially in a central portion of said top surface pocket.

9. The device of claim 1 with the top surface further comprising an additional horizontal dividing member located along the rear side of the display member.

10. The device of claim 1 with the top surface further comprising an additional horizontal dividing member located along the front side of the display member.

11. The device of claim 1 wherein each of the horizontal dividing members of the top surface extends laterally from the left side of the display member to the right side of the display member.

12. The device of claim 1 wherein each of the horizontal dividing members of the top surface is oriented substantially parallel to each other of the horizontal dividing members of the top surface.

13. The device of claim 1 wherein each of the intermediate dividing members of the top surface is oriented substantially parallel to each other of the intermediate dividing members of the top surface located within the same horizontal row as said intermediate dividing member.

14. The device of claim 1 wherein each horizontal dividing member of the top surface extends upward from the top surface of the display member, is wider closer to the top surface of the display member, and tapers significantly as it extends upward away from the top surface of the display member, culminating in a top edge.

15. The device of claim 14 wherein each top surface pocket has a lowest point located substantially in a central portion of said top surface pocket; and each horizontal dividing member of the top surface has a height measured from the top edge of said horizontal dividing member to the lowest point of a top surface pocket adjacent to said horizontal dividing member, whereby the height of each of the horizontal dividing members of the top surface is substantially the same as the height of each other horizontal dividing member of the top surface.

16. The device of claim 15 wherein each intermediate dividing member of the top surface extends upward from the top surface of the display member, is wider closer to the top surface of the display member, and narrows slightly as it extends upward away from the top surface of the display member, culminating in a top edge, and each intermediate dividing member of the top surface has a height measured from the top edge of said intermediate dividing member to the lowest point of a top surface pocket adjacent to said intermediate dividing member, whereby the height of each of the intermediate dividing members of the top surface is substantially the same as the height of each other intermediate dividing member of the top surface and the height of each horizontal dividing member of the top surface is greater than the height of each intermediate dividing member of the top surface.

17. The device of claim 1 wherein each intermediate dividing member of the top surface extends upward from the top surface of the display member, is wider closer to the top surface of the display member, and narrows slightly as it extends upward away from the top surface of the display member, culminating in a top edge.

18. The device of claim 1 wherein each lower surface pocket is substantially rectangular.

19. The device of claim 1 wherein the dimensions of each lower surface pocket are different from the dimensions of each top surface pocket.

20. The device of claim 1 wherein each individual lower surface pocket is vertically aligned with a lower surface pocket in an adjacent horizontal row of lower surface pockets.

21. The device of claim 1 wherein each lower surface pocket has a lowest point located substantially in a central portion of said lower surface pocket.

22. The device of claim 1 wherein the lower surface further comprises an additional horizontal dividing member located along the rear side of the display member.

23. The device of claim 1 wherein the lower surface further comprises an additional horizontal dividing member located along the front side of the display member.

24. The device of claim 1 wherein each of the horizontal dividing members of the lower surface extends laterally from the left side of the display member to the right side of the display member.

25. The device of claim 1 wherein each of the horizontal dividing members of the lower surface is oriented substantially parallel to each other of the horizontal dividing members of the lower surface.

26. The device of claim 1 wherein each of the intermediate dividing members of the lower surface is oriented substantially parallel to each other of the intermediate dividing members of the lower surface located within the same horizontal row as said intermediate dividing member.

27. The device of claim 1 wherein each horizontal dividing member of the lower surface extends downward from the lower surface of the display member, is wider closer to the lower surface of the display member, and tapers significantly as it extends downward away from the lower surface of the display member, culminating in a top edge.

28. The device of claim 27 wherein each lower surface pocket has a lowest point located substantially in a central portion of said lower surface pocket; and each horizontal dividing member of the lower surface has a height measured from the top edge of said horizontal dividing member to the lowest point of a lower surface pocket adjacent to said horizontal dividing member, whereby the height of each of the horizontal dividing members of the lower surface is substantially the same as the height of each other horizontal dividing member of the lower surface.

29. The device of claim 28 wherein each intermediate dividing member of the lower surface extends downward from the lower surface of the display member, is wider closer to the lower surface of the display member, and narrows slightly as it extends downward away from the lower surface of the display member, culminating in a top edge, and each intermediate dividing member of the lower surface has a height measured from the top edge of said intermediate dividing member to the lowest point of a lower surface pocket adjacent to said intermediate dividing member, whereby the height of each of the intermediate dividing members of the lower surface is substantially the same as the height of each other intermediate dividing member of the lower surface and the height of each horizontal dividing member of the lower surface is greater than the height of each intermediate dividing member of the lower surface.

30. The device of claim 1 wherein each intermediate dividing member of the lower surface extends downward from the lower surface of the display member, is wider closer to the lower surface of the display member, and narrows slightly as it extends downward away from the lower surface of the display member, culminating in a top edge.

31. The device of claim 1 wherein the top surface is adjacent to the front, rear, left, and right sides of the display member, the lower surface is adjacent to the front, rear, left, and right sides of the display member, the front side of the display member is substantially planar, said front side being adjacent to the left and right sides of the display member, the rear side of the display member is substantially planar, said rear side being adjacent to the left and right sides of the display member, the left side of the display member is substantially planar, the right side of the display member is substantially planar, the front side of the display member is substantially parallel to the rear side of the display member, the left side of the display member is substantially parallel to the right side of the display member, the front side of the display member is substantially perpendicular to the left side of the display member, the front side of the display member is substantially perpendicular to the right side of the display member, the rear side of the display member is substantially perpendicular to the left side of the display member, and the rear side of the display member is substantially perpendicular to the right side of the display member.

* * * * *